United States Patent [19]

Wiebe

[11] Patent Number: 4,996,816

[45] Date of Patent: Mar. 5, 1991

[54] SUPPORT FOR ELONGATE MEMBERS IN A POURED LAYER

[76] Inventor: Jacob R. Wiebe, 60 Heaton Avenue, Winnipeg, Manitoba, Canada, R3R 3E3

[21] Appl. No.: 418,233

[22] Filed: Oct. 6, 1989

[51] Int. Cl.[5] ..... E04B 1/00

[52] U.S. Cl. ..... 52/742; 52/687; 52/686; 404/134

[58] Field of Search ..... 52/741, 684–687, 52/742; 404/70, 72, 134

[56] References Cited

U.S. PATENT DOCUMENTS

| | | | |
|---|---|---|---|
| 3,245,191 | 4/1966 | Ernst | 52/686 |
| 3,397,626 | 8/1968 | Kormick et al. | 404/134 X |
| 3,702,093 | 11/1972 | Van de Loock et al. | 404/70 X |
| 3,870,428 | 3/1975 | Jackson | 404/134 |
| 4,689,867 | 9/1987 | Tolliver | 52/687 X |
| 4,744,190 | 5/1988 | Couwenbergs et al. | 52/687 X |

FOREIGN PATENT DOCUMENTS

| | | | |
|---|---|---|---|
| 2043790 | 3/1972 | Fed. Rep. of Germany | 52/687 |
| 2228868 | 1/1974 | Fed. Rep. of Germany | 52/687 |

*Primary Examiner*—David A. Scherbel
*Assistant Examiner*—Lan Mai
*Attorney, Agent, or Firm*—Adrian D. Battison; Stanley G. Ade; Murray E. Thrift

[57] ABSTRACT

A support device for supporting longitudinal rigid members in a poured layer for example rebar within concrete comprises two V-shaped wire elements which are inverted and have parallel rails welded across the elements. Two lower rails are spaced at the end of the legs of the elements to allow the ends of the legs to be inserted into the ground. The elongate members then rest across the upper rails between two apex portions of the elements which extend upwardly above the upper rails. The rails extend out beyond the elements to provide portions which can be inserted into the ground when the device is rotated through 90° to support the elongate members at a different height from the base layer. The use of a wire structure enables the concrete to be poured around the device without the formation of voids. The use of four legs inserted into a sand or similar base provides great stability.

14 Claims, 2 Drawing Sheets

SUPPORT FOR ELONGATE MEMBERS IN A POURED LAYER

BACKGROUND OF THE INVENTION

This invention relates to a support device for supporting elongate members during embedding of the members in a poured layer.

During the pouring of concrete and other solid layers is often necessary to bury within the concrete elongate structural members which reinforce the concrete. In many cases the elongate structural elements comprise rebar which is simple steel rod but in other cases the elongate members can comprise pipe for example in the laying of cooling pipes for an ice rink.

The conventional technique for supporting rebar in a concrete layer comprises driving a single vertical pin into the supporting layer of sand or other particulate material, the pin having a hook shaped element at the top for receiving the rebar and a transverse rod for resting against the upper surface of the supporting layer. These pins have a number of disadvantages in that they are difficult and time consuming to install and in that they are in many cases relatively unstable.

U.S. Pat. No. 3,245,191 (Ernst) discloses a support element for use in the pouring of floors of a concrete building. The support member is formed from wire defined by two separate elements having a horizontal cross bar and two depending legs together with longitudinal wires which connect the elements. Two of the wires sit on top of the cross bars and two of the wires are arranged adjacent to but spaced from the end of the legs. The two lower cross bars are arranged to sit over rebar lying across shuttering at the bottom of the floor to be poured. The two upper cross bars are arranged to support the rebar at the upper part of the floor to be poured. This device is designed specifically for use in pouring of flooring over a rigid shuttering formed by for example wooden panels and has not been considered for and is not suitable for use in pouring concrete layers on a particulate support layer such as sand. While this device therefore has some structural simularity the construction of the present invention, it is designed for an entirely different purpose and the various structural parts have an entirely different intention.

SUMMARY OF THE INVENTION

It is one object of the present invention, therefore, to provide a support device for supporting elongate members for example rebar during embedding of the rebar in a poured layer over a supporting particulate layer.

According to the first aspect of the invention, therefore, there is provided a support device for supporting elongate members during embedding of those members in a poured layer, the support device comprising a first and a second element, each element defining a pair of legs depending from a central apex portion between the legs, and at least three separate parallel coupling wires extending from the first element to the second element substantially at right angles to each of the elements and arranged to hold the elements in spaced aligned position, each of two of the wires being connected to the elements at a position thereon adjacent to but spaced from a lower end of a respective one of the legs, and a third of the wires being connected to one of the legs at a position adjacent to but spaced downwardly from said apex portion.

According to the second aspect of the invention there is provided a method of supporting elongate members during embedding of the members in a poured layer comprising providing a particulate base on which the layer is to be poured, mounting on the particulate layer a support device comprising a first and second element, each element defining a pair of legs depending from a central apex portion between the legs, and at least three separate parallel coupling wires extending from the first element to the second element substantially at right angles to each of the elements and arranged to hold the elements in spaced aligned position, each of two of the wires being connected to the elements at a position thereon adjacent to but spaced from a lower end of a respective one of the legs, and a third of the wires being connected to one of the legs at a position adjacent to but spaced downwardly from said apex portion, pressing into the particulate layer a lower portion of said legs to cause said two wire elements to engage the layer thus maintaining the support device in stable position on the layer, and laying one of the elongate members across said third of the wires between said apex portions.

According to a third aspect of the invention there is provided a method of supporting elongate members during embedding of the members in a poured layer comprising providing a particulate base on which the layer is to be poured, mounting on the particulate layer a support device, comprising a first and second element, each element defining a pair of legs depending from a central apex portion between the legs, and at least three separate parallel coupling wires extending from the first element to the second element substantially at right angles to each of the elements and arranged to hold the elements in spaced aligned position, each of two of the wires being connected to the elements at a position thereon adjacent to but spaced from a lower end of a respective one of the legs, and a third of the wires being connected to one of the legs at a position adjacent to but spaced downwardly from said apex portion, the wires extending beyond the elements such that the length of the portions of the wires extending beyond the elements is substantially equal to the distance of the wires from the end of the legs and spacing between the elements being different from the spacing of one of said two wires from the third wire, pressing into the particulate one of the portions of the wires and the portions of the legs to cause said portions to engage the layer thus maintaining the support device in stable position on the layer, and laying one of the elongate members across support device.

With the foregoing in view, and other advantages as will become apparent to those skilled in the art to which this invention relates as this specification proceeds, the invention is herein described by reference to the accompanying drawings forming a part hereof, which includes a description of the best mode known to the application and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
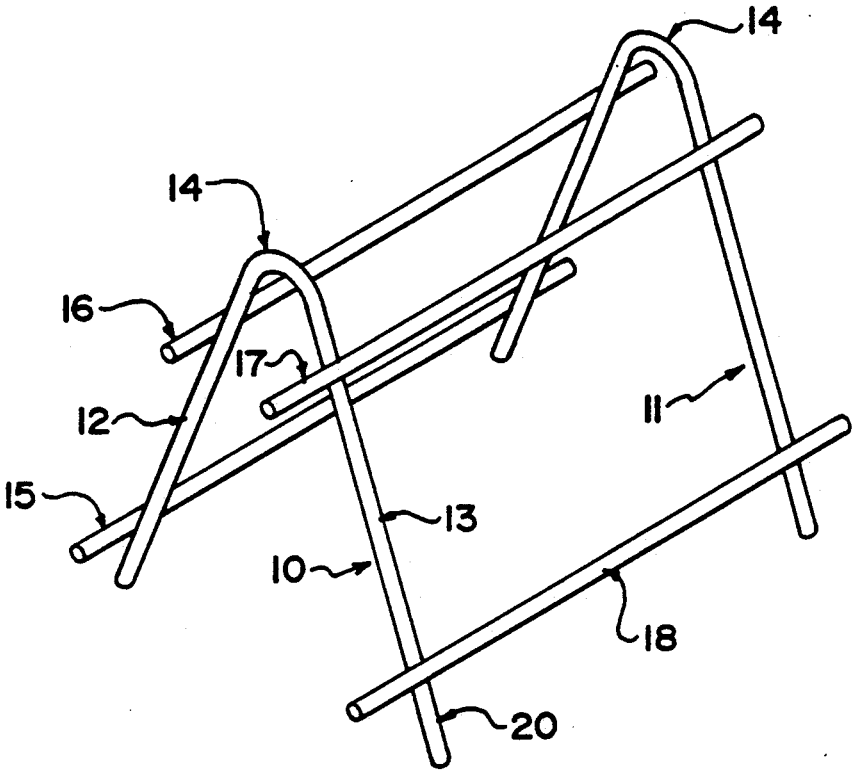
FIG. 1 is an isometric view of the support device according to the invention.
Figure 2:
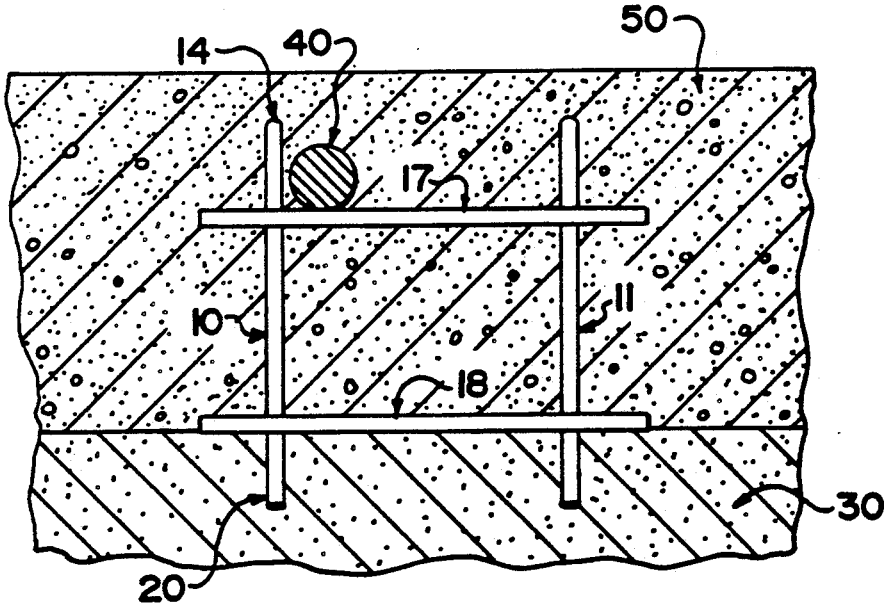
FIG. 2 is a side-elevational view of the device of FIG. 1 in position in a poured layer of concrete.
Figure 3:
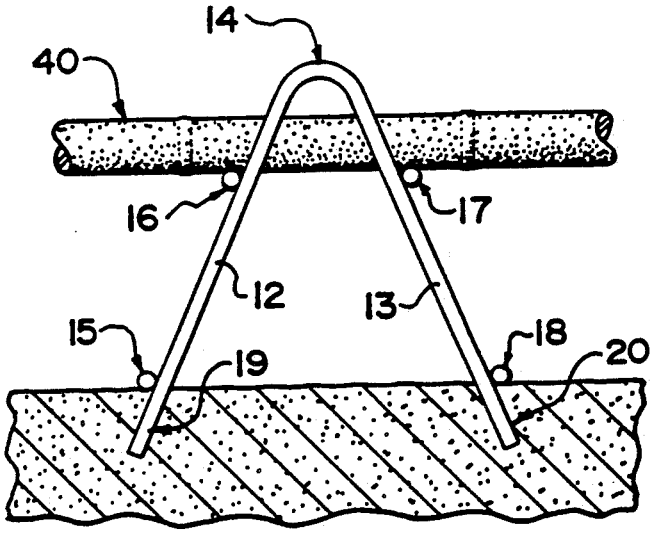
FIG. 3 is an end-elevational view of the support device of FIG. 1 showing the support device mounted upon a support layer and carrying a portion of rebar material.

The support device of FIGS. 1, 2 and 3 comprises a pair of elements 10 and 11 each of which is formed from a single wire bent to form an inverted V-shape. Each element thus defines a pair of legs 12 and 13 and a central apex portion 14 at which the wire is bent.

Four rails 15, 16, 17 and 18 are also provided extending from one element to the other element and welded to both to form the support device into an integral structure. The rails are formed from the same wire as the wire defining the elements 10 and 11. The wire is of a sufficiently thick gauge to provide support for the rebar or other elements to be supported together with the weight of the operatives involved installing the supports since often the operatives walk on the whole structure and use their weight to insert the support device into the ground.

Two lower rails 15 and 18 are welded on the outer sides of the legs 12 and 13 adjacent to but spaced from the lowermost ends thereof. This leaves a lowermost portion 19 and 20 of each of the legs which projects downwardly beyond the respective rail. The upper rails 16 and 17 are welded on the outer sides of the legs 12 and 13 at a position spaced downwardly from the apex portion 14.

The rails are co-extensive in length and the elements 10 and 11 are welded to the rails at a position spaced inwardly from the ends of the rails so as to leave an outermost end portion extending beyond the respective one of the elements. The elements are supported in spaced, parallel, aligned relationship. The length of the portion of each of the rails extending beyond their respective element is substantially equal to the length of the portions 19 and 20 of the legs. The distance between the rails 17 and 18 is equal to the distance between the rails 15 and 16 and is different from the distance between the elements 10 and 11. In one example the distance between the rails 17 and 18 is of the order of three inches and the distance between the elements 10 and 11 is of the order of four inches.

The support device can be manufactured by welding across two continuous straight wires the rails 15 through 18 and then cutting the wires into sufficient length to form the elements 10 and 11 followed by bending the wires at a centre position to form the apex 14.

In operation of the support device as shown in FIGS. 2 and 3, the device is intended for use with a particulate support layer 30 which is generally of sand, gravel or similar materials which can be penetrated. The device is then laid in position with the portions 19 and 20 resting upon the support layer. The foot of the user can then be applied across the rails 16 and 17 to apply downward force by the weight of the user and this acts to force the portions 19 and 20 into the ground. In one example the length of these portions is of the order of $\frac{3}{4}$ inch to one inch and this provides a significant stability for the device particularly bearing in mind that there are four such portions which penetrate into the ground at four corners of the unit. The rails 15 and 18 then rest against the upper surface of the support layer 30 to provide yet further stability for the device. The rebar 40 can then be laid across the upper rails 16 and 17 in between the apex portion 14. The rebar is thus confined by the apex portions to sit in the channel shaped area shown in FIG. 2 between the elements and above the rails. To provide yet further stability for the rebar, the support device can be rotated so that the rebar contacts one leg of one element and the opposite legs of the other element thus extending substantially diagonally across the area between the elements to hold the rebar against twisting. When using rebar of the grid type which is supplied in welded rectangular grids, the support device can be mounted at a junction between two of the crossing elements of the grid and can be twisted so that it holds both elements against movement by contacting the side of the apex portion against a side of the rebar elements.

The use of the device in the orientation shown in FIGS. 2 and 3 provides a support of the rebar at a height three inches above the base layer 30. Rotation of the support device through 90° to take up an orientation in which the rails are vertical allows the support device to be used in an arrangement which holds the rebar at a height four inches above the support layer. In some cases this height difference is required depending upon the thickness of the concrete layer 50 to be poured. In the second orientation of the device the ends of the rails adjacent one element are inserted into the ground by pressing as previously described until the element engages the ground and holds the unit stable. The rebar is then positioned resting upon the other of the elements and is maintained in location against horizontal movement by its contact with the upper projecting ends of the rails.

In an alternative arrangement (not shown), one of the upper rails 16 and 17 can be omitted leaving the rebar supported upon a single rail between the apex portions. This is much less preferred but is a mechanical possibility.

Figure 4:
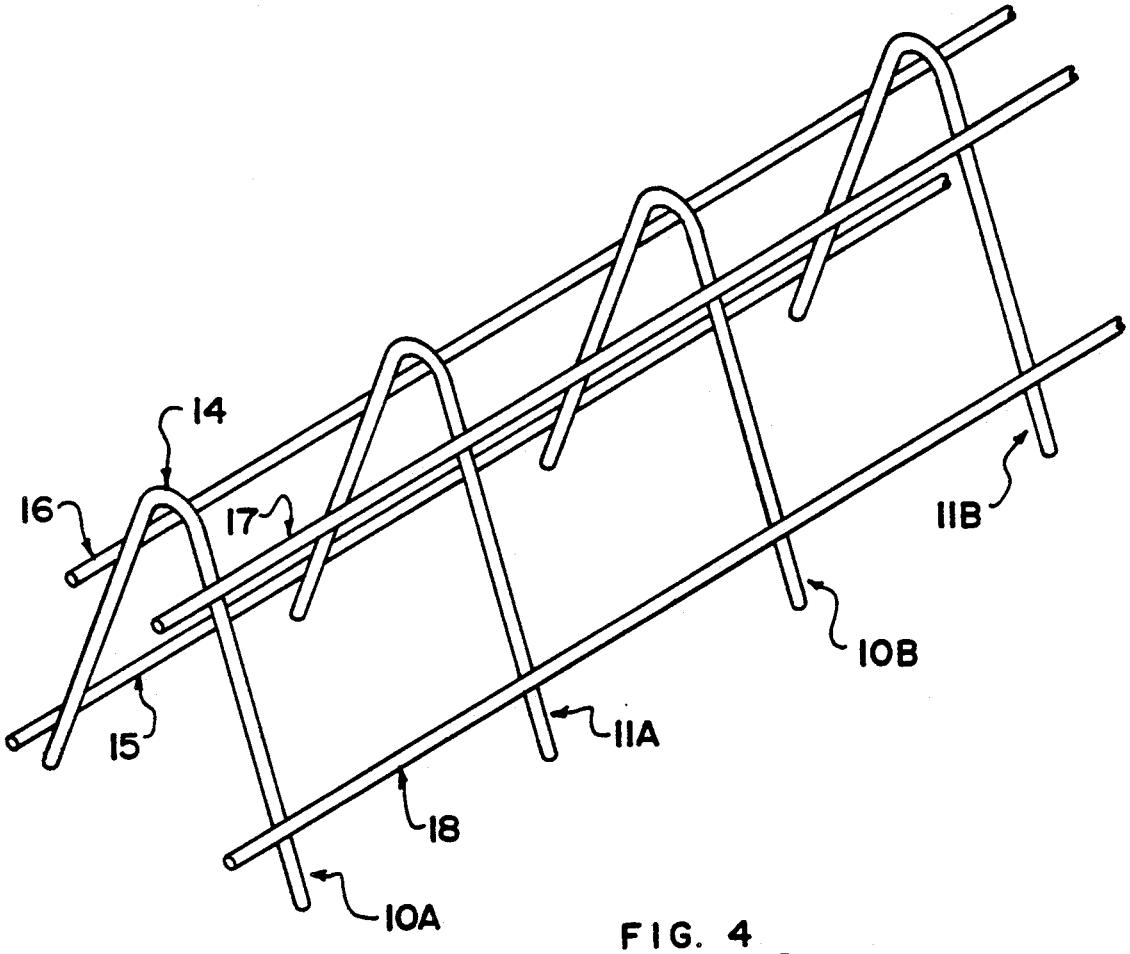
FIG. 4 is an isometric view of a second embodiment of support device according to the invention.

In FIG. 4 is shown a second embodiment of a support device which is substantially the same construction as shown in FIG. 1 except that it is extended by the provision of yet further elements 10A, 11A, 10B, 11B, etc. Such a device can be used for supporting a plurality of parallel reinforcing members in the poured layer with the elements upright in basically the arrangement previously described in that the lowermost portions of the elements are inserted into the supporting layer to act as a stabilizing structure and the elongate members to be supported are rested against the upper rails between the apex portions. The material can then be poured around the support elements and through the wire structure to complete the poured layer.

The use of the wire structure enables the device to be manufactured cheaply and simply. The wire structure also enables the poured material to enter into the spaces around the support devices without the formation of a voids. The provision of the lowermost portions of the wires which are inserted into the supporting layer provides great stability without the necessity of hammering the device into the layer to a significant depth. The engagement of the lowermost portion with the ground prevents the tendency of the reinforcing structure to move sideways as the concrete is poured over the reinforcing structure and pushed into the required layer.

The length of the lowermost projecting portion and legs can vary depending upon the type of ground with which it is to be used and the amount of anchoring required.

Since various modifications can be made in my invention as hereinabove described, and many apparently widely different embodiments of same made within the spirit and scope of the claims without departing from such spirit and scope it is intended that all matter contained in the accompanying specification shall be interpreted as illustrative only and not in a limiting sense.

I claim:

1. A method of supporting elongate members during embedding of the members in a poured layer comprising providing a particulate base on which the layer is to be poured, mounting on the particulate base a support device comprising a first and a second element, each element defining a pair of legs depending from a central apex portion between the legs, and at least three separate parallel coupling wires extending from the first element to the second element substantially at right angles to each of the elements and arranged to hold the elements in spaced aligned position, each of two of the wires being connected to each of the elements at a position thereon adjacent to but spaced from a lower end of a respective one of the legs thus defining a lower portion of the leg between the wire and the end of the leg, and a third of the wires being connected to one of the legs of each element at a position adjacent to but spaced downwardly from said apex portion, pressing into the particulate base said lower portion of said legs so that the lower portions up to said two wire elements are fully embedded into the base thus maintaining the support device in stable position on the base, laying one of the elongate members across said third of the wires between and below said apex portions, confining said elongate member against side to side movement between said apex portion, and pouring the layer onto the base.

2. The invention according to claim 1 wherein each of the elements is formed by bending from a single wire.

3. The invention according to claim 1 wherein each of the elements is of inverted V-shape.

4. The invention according to claim 1 wherein there is provided a fourth wire connected to the other of the legs at a position adjacent to but spaced downwardly from said apex portion.

5. The invention according to claim 1 wherein said two of the wires lie in a first plane which is horizontal and wherein the third and fourth wires lie in a second plane which is horizontal and spaced upwardly from the first plane.

6. The invention according to claim 1 wherein the wires are co-extensive.

7. The invention according to claim 1 wherein the elements are maintained in mutually parallel position.

8. A method of supporting elongate members during embedding of the members in a poured layer comprising providing a particulate base on which the layer is to be poured, mounting on the particulate base a support device comprising a first and a second element, each element defining a pair of legs depending from a central apex portion between the legs, and at least three separate parallel coupling wires extending from the first element to the second element substantially at right angles to each of the elements and arranged to hold the elements in spaced aligned position, each of two of the wires being connected to each of the elements at a position thereon adjacent to but spaced from a lower end of a respective one of the legs thus defining a lower portion of the leg between the wire and the end of the leg, and a third of the wires being connected to one of the legs of each element at a position adjacent to but spaced downwardly from said apex portion, each of the wires extending beyond the elements to define end portions such that the length of the end portions of the wires extending beyond the elements is substantially equal to the length of the lower portion of the legs, defining a spacing between the elements which is different from the spacing of one of said two wires from the third wire, selecting an orientation of the support device depending upon a required spacing of the elongate members from the particulate base, depending upon the orientation selected pressing into the particulate base so as to be embedded therein one of those end portions of the wires beyond one of the elements and the lower portions of the legs beyond said first and second wires to cause said device to engage the base thus maintaining the support device in stable position on the base, laying one of the elongate members across said support device, confining said elongate member against side to side movement between upwardly projecting portions of said device, and pouring the layer onto the base.

9. The invention according to claim 8 wherein each of the elements is formed by bending from a single wire.

10. The invention according to claim 9 wherein each of the elements is of inverted V-shape.

11. The invention according to claim 8 wherein there is provided a fourth wire connected to the other of the legs at a position adjacent to but spaced downwardly from said apex portion.

12. The invention according to claim 11 wherein said two of the wires lie in a first plane which is horizontal and wherein the third and fourth wires lie in a second plane which is horizontal and spaced upwardly from the first plane.

13. The invention according to claim 8 wherein the wires are co-extensive.

14. The invention according to claim 8 wherein the elements are maintained in mutually parallel position.

* * * * *